US005792034A

United States Patent [19]

Kozlovsky

[11] Patent Number: 5,792,034

[45] Date of Patent: Aug. 11, 1998

[54] MUSCLE BUILDING BODY ADHERING APPARATUS

[75] Inventor: Oren Kozlovsky, Ramat Gan, Israel

[73] Assignee: K.T.S. Development, Haifa, Israel

[21] Appl. No.: 823,662

[22] Filed: Mar. 18, 1997

[30] Foreign Application Priority Data

Jan. 21, 1997 [IT] Italy ..... 120048

[51] Int. Cl.[6] ..... A63B 21/02

[52] U.S. Cl. ..... 482/124; 482/74

[58] Field of Search ..... 482/74, 69, 124, 482/125, 105

[56] References Cited

U.S. PATENT DOCUMENTS

| | | | |
|---|---|---|---|
| 650,656 | 5/1900 | Raabe . | |
| 712,827 | 11/1902 | Maxwell et al. . | |
| 866,495 | 9/1907 | Marks . | |
| 1,194,884 | 8/1916 | Sandow . | |
| 1,402,179 | 1/1922 | Piscitelli . | |
| 1,618,273 | 2/1927 | Davidson . | |
| 1,663,641 | 3/1928 | Smallwood . | |
| 2,035,010 | 3/1936 | Rawlings . | |
| 2,097,376 | 10/1937 | Marshman . | |
| 3,162,441 | 12/1964 | Karlik . | |
| 3,162,442 | 12/1964 | Karlik . | |
| 3,370,850 | 2/1968 | Moore | 482/105 |
| 4,273,328 | 6/1981 | Ozbey et al. . | |
| 4,540,173 | 9/1985 | Hopkins, Jr. . | |
| 4,594,583 | 6/1986 | Seko et al. . | |
| 4,604,611 | 8/1986 | Seko et al. . | |
| 4,961,573 | 10/1990 | Wehrell . | |
| 4,986,536 | 1/1991 | Zane | 482/105 |
| 4,993,705 | 2/1991 | Tolle . | |
| 5,167,600 | 12/1992 | Baird | 482/105 |
| 5,176,600 | 1/1993 | Wilkinson . | |
| 5,186,701 | 2/1993 | Wilkinson . | |
| 5,203,754 | 4/1993 | Maclean . | |
| 5,232,426 | 8/1993 | Van Straaten . | |
| 5,306,222 | 4/1994 | Wilkinson . | |
| 5,358,461 | 10/1994 | Bailey, Jr. . | |
| 5,411,461 | 5/1995 | Thomascik . | |
| 5,433,688 | 7/1995 | Davies . | |
| 5,518,481 | 5/1996 | Darkwah . | |

*Primary Examiner*—Lynne A. Reichard
*Attorney, Agent, or Firm*—Michael N. Meller

[57] ABSTRACT

Fitness apparatus including an upper body wearable protective shell formed of a generally planar web material, which is sufficiently flexible so as to be generally conformable to a user's body and generally impact resistant, a plurality of resiliently stretchable elongate elements mounted at first ends thereof on the protective shell; and a plurality of user appendage engagement attachments mounted at second ends of respective ones of the elongate elements.

20 Claims, 10 Drawing Sheets

MUSCLE BUILDING BODY ADHERING APPARATUS

FIELD OF THE INVENTION

The present invention relates to exercise devices generally, and particularly to portable exercise devices worn by a user for exercising both the upper and lower parts of the body.

BACKGROUND OF THE INVENTION

A great variety of body-worn exercise devices that exercise the muscles of the user by means of resistance devices, such as resilient elements or springs are known in the art. These devices include belts, vests and/or suits with such accessories as springs, elastic elements and pulleys, for example.

The following patents are believed to be representative of the art: U.S. Pat. Nos. 1,402,179, 2,035,010, 4,273,328, 4,540,173, 4,961,573, 4,993,705, 5,358,461, 5,411,461, 5,433,688 and 5,518,481 describe portable devices for exercising the upper body alone. U.S. Pat. No. 5,203,754 describes a portable device for exercising the lower body alone. U.S. Pat. Nos. 650,656, 712,827, 866,495, 1,194,884, 1,618,273, 1,663,641, 2,097,376, 3,162,441, 3,162,442, 5,176,600, 5,186,701 and 5,306,222 describe portable devices for exercising both the upper and lower body.

SUMMARY OF THE INVENTION

The present invention seeks to provide improved fitness apparatus which includes a solid back support and a plurality of resilient exercise elements, shaped as a work-out suit in order to provide a full range of exercise and fitness training. The invention provides a lightweight foldable vest that forms a back carryable fitness center with over 60 basic training routines for upper and lower body building and for exercising all major muscle groups.

There is thus provided in accordance with a preferred embodiment of the present invention, fitness apparatus including an upper body wearable protective shell formed of a generally planar web material, which is sufficiently flexible so as to be generally conformable to a user's body and generally impact resistant, a plurality of resiliently stretchable elongate elements mounted at first ends thereof on the protective shell; and a plurality of user appendage engagement attachments mounted at second ends of respective ones of the elongate elements.

Preferably, the protective shell is formed of more than one piece which are attachable together in plural arrangements in order to accommodate differently sized users.

In accordance with a preferred embodiment of the present invention, the fitness apparatus also includes a back support belt which secures the protective shell to a user's body and limits upward and downward movement of the protective shell relative to the user's body.

Preferably, the fitness apparatus also includes adjustable padded shoulder straps associated with the protective shell and padding formed on an inside, body facing surface of the web material.

It is a particular feature of the present invention that the protective shell, when mounted on a user's body, moves with the user's body and permits relatively free body motion.

Preferably, the elongate elements are mounted at first ends thereof on the protective shell by means of a central mounting connector located on the protective shell at a location lying between the top third and lower two thirds of the upper body of the user.

In accordance with a preferred embodiment of the present invention, the fitness apparatus also includes a plurality of relatively low friction guide elements, each associated with at least one of the elongate elements and being located in the vicinity of a natural pivot location of a body appendage sought to be exercised by stretching of the at least one elongate element.

Preferably, the fitness apparatus also includes rollers mounted on the protective shell intermediate the central mounting connector and the guide elements and underlying the elongate elements.

It is a particular feature of the present invention that sudden release of any one of the elongate elements when stretched causes a corresponding one of the user appendage engagement attachments to impact on the protective shell.

Preferably, each of the plurality of user appendage engagement attachments is selectably attached to a second end of a selectable number the plurality of resilient elongate elements, thereby to provide a desired amount of resistance to stretching. In accordance with a preferred embodiment of the present invention, the plurality of resilient elongate elements includes resilient elongate elements having differing resistance to stretching. Preferably, each of the resilient elongate elements can be stretched to at least 3–4 times its length.

There is also provided in accordance with a preferred embodiment of the present invention fitness apparatus comprising:

a vest which covers a majority of an upper body of a user, the vest having a waistband which may be wrapped around the user, the waistband being sufficiently wide and stiff to provide support to a midriff and a back of the user;

a plurality of resilient elements, each of the elements having a grip attached at an end thereof;

a central connector fixedly mounted on a central portion of a back portion of the vest; and a plurality of element guides fixedly mounted on the back portion of the vest; two of the element guides being located at respective right shoulder and left shoulder portions of the vest and another two of the element guides being located at respective right hip and left hip portions of the vest;

wherein the elements pass through the element guides and extend at least to the central connector, the grips being arranged for grasping by a right hand and a left hand of the user, and for engaging a right foot and a left foot of the user, wherein the vest is sufficiently rigid to protect the user from striking thereagainst by one of the elements and the grips upon sudden release thereof when stretched. Preferably, the plurality of elements comprises elements of different tensile resistance to pulling.

Preferably, the elongate elements are color coded to indicate their tensile resistance to pulling.

In accordance with a preferred embodiment of the invention at least one of the elongate elements has grips at both opposite ends thereof and passes through the element central connector and two of the element guides.

Preferably, the protective shell has ventilation openings formed therein.

BRIEF DESCRIPTION OF THE DRAWINGS

The present invention will be understood and appreciated more fully from the following detailed description, taken in conjunction with the drawings in which.

DETAILED DESCRIPTION OF THE PREFERRED EMBODIMENTS

Figure 1:
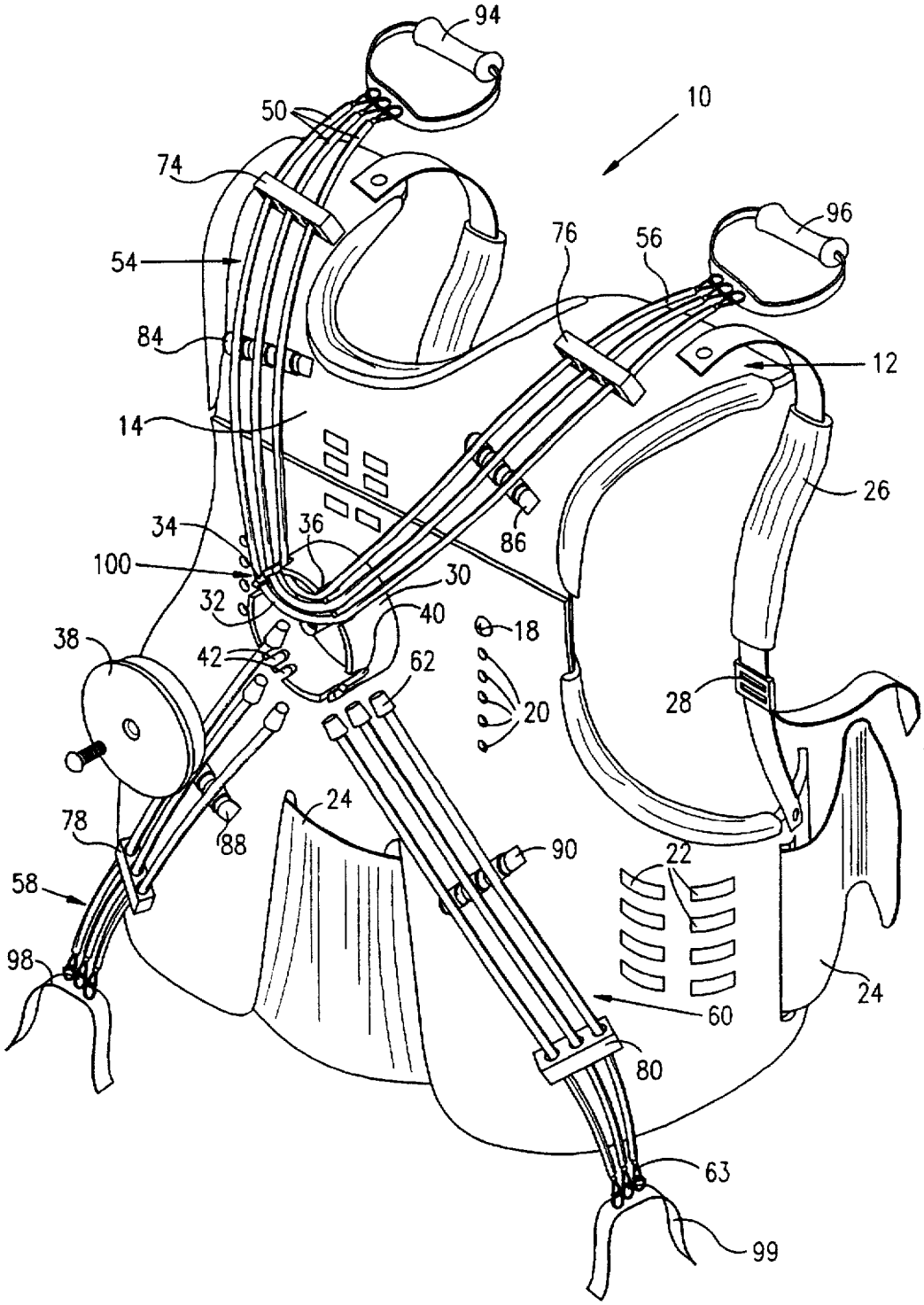
FIG. 1 is a simplified pictorial illustration of fitness apparatus, constructed and operative in accordance with a preferred embodiment of the present invention.
Figure 2A:
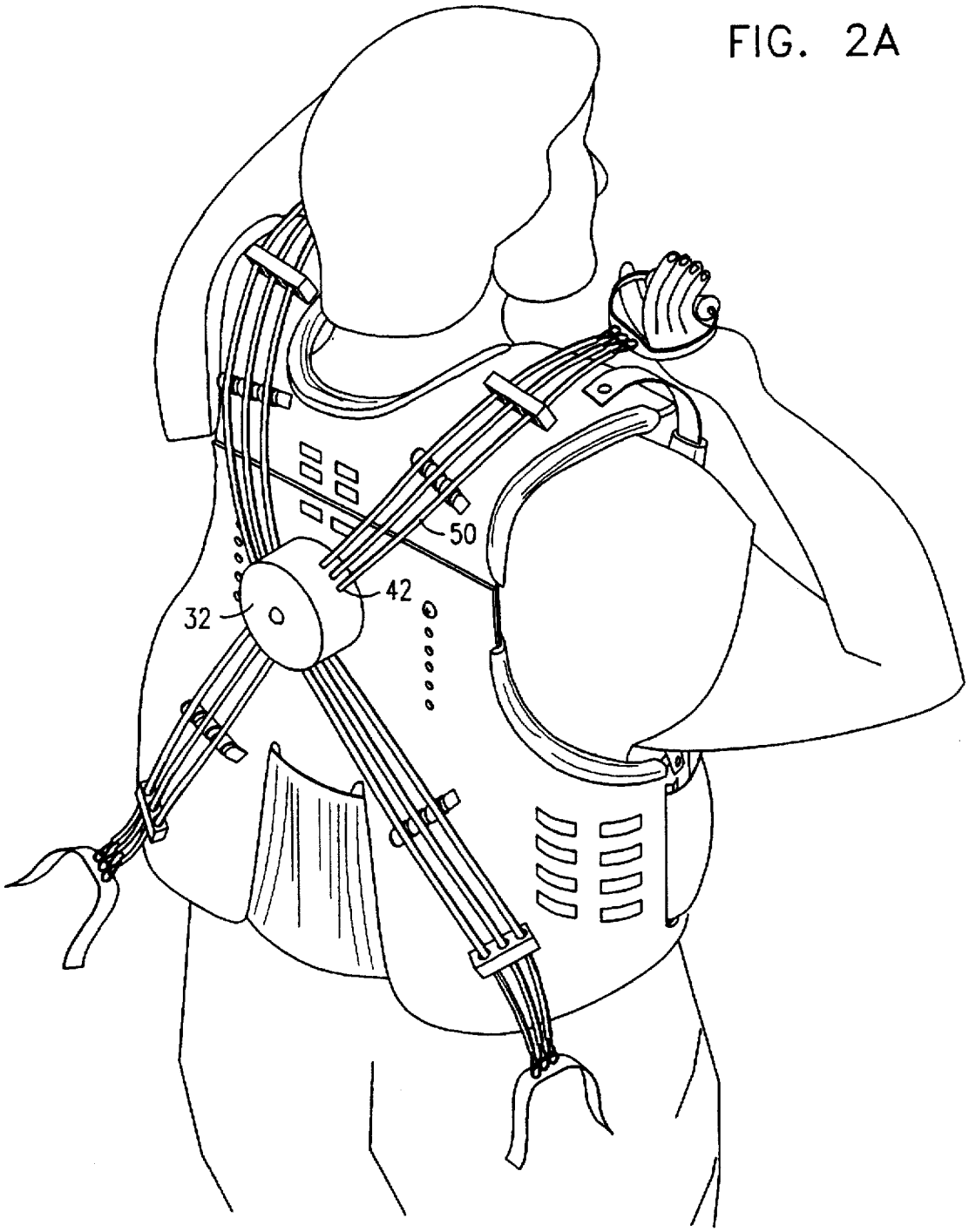
FIGS. 2A and 2B are respective rear and front view pictorial illustrations of the fitness apparatus of FIG. 1 worn by a user.
Figure 2B:
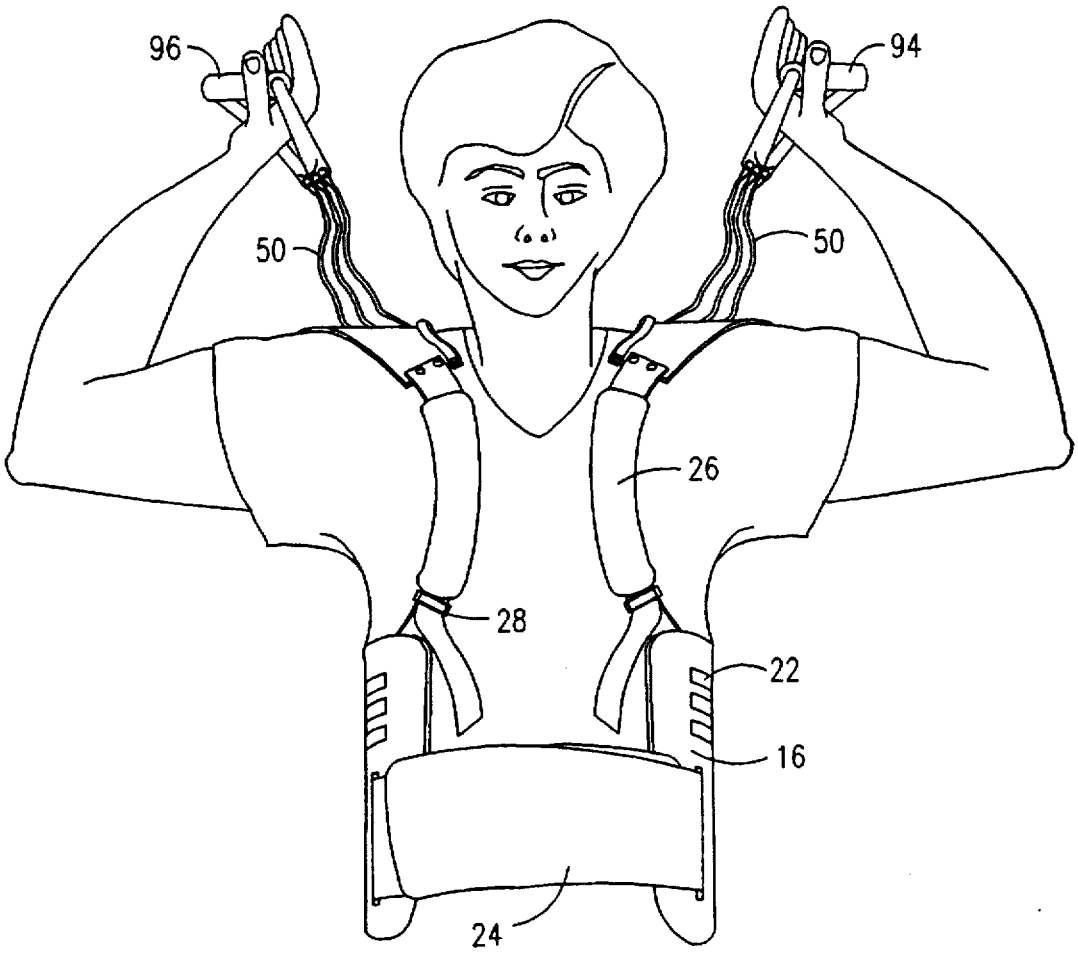

Reference is now made to FIGS. 1, 2A and 2B which illustrate fitness apparatus 10, constructed and operative in accordance with a preferred embodiment of the present invention.

Fitness apparatus 10 preferably includes a two-piece protective shell 12, in the form of a vest which is designed to be worn on the upper body of a user. The protective shell 12 preferably comprises an upper back portion 14 and a lower back portion 16 which may be joined together at various relative positions to accommodate differently sized users.

The upper and lower back portions 14 and 16 are typically removably joined by fasteners 18 which engage selected ones of a plurality of mounting apertures 20 corresponding to different user sizes. The upper and lower back portions 14 and 16 are typically made of a flexible but impact resistant web material, such as a plastic material, which is sufficiently flexible so as to generally confirm to the share of the user's upper body and to move with the user during normal body movements and exercise, but is also sufficiently strong so as to protect the user against spurious impacts. Preferably, the upper and lower back portions are formed with ventilation apertures 22 at various locations thereon.

In accordance with a preferred embodiment of the invention, a back support belt 24 is associated with the lower back portion 16 and is used to secure the protective shell 12 onto the body of the user and to limit upward, downward and other movements of the protective shell relative to the user's body. The back support belt 24 preferably extends through suitable slits formed in the lower back portion 16 and is fastened at its ends as by a VELCRO R fastener. The back support belt 24 is preferably sufficiently wide and stiff to provide support to a midriff and a back of the user.

Padded shoulder straps 26 interconnect the upper and lower back portions 14 and 16 and are suitably tightened by means of suitable clasps 28.

In accordance with a preferred embodiment of the present invention, fitness apparatus 10 preferably includes a central connector 30, which is fixedly mounted at a central location on the protective shell 12, preferably on the lower back portion 16 at a location lying between the top third and the lower two thirds of the upper body of the user. Central connector 30 preferably comprises a cylindrical housing member 32 having four groups 34, 36, 38 and 40 of retaining slots 42 arranged generally in directions facing the right and left shoulders and the right and left hips of the user respectively. Typically, each group contains three adjacent slots.

A plurality of resilient elongate elements 50 are provided in engagement with the protective shell 12. In accordance with a preferred embodiment of the present invention four groups 54, 56, 58 and 60 of three resilient elongate elements 50 each are provided, each of the three resilient elongate elements in a group having a different tensile resistance to stretching.

Each of the elongate elements 50 is provided with a mounting connector 62 at first and second ends thereof In accordance with a preferred embodiment of the invention, the first ends of each of the elongate elements 50 are secured by the central connector, as illustrated in FIG. 2, wherein the mounting connector 62 is retained interior of the cylindrical housing member 32 and the elongate element 50 extends through retaining slot 42, the mounting connector 62 being too large to pass through slot 42.

Groups 54, 56, 58 and 60 of elongate elements 50 extend outwardly from respective groups 34, 36, 38 and 40 of retaining slots 42 in the central connector 30 and extend generally in directions facing the right and left shoulders and the right and left hips of the user respectively to respective guide elements 74, 76, 78 and 80. Intermediate the central connector 30 and the respective guide elements 74, 76, 78 and 80, the elongate elements 50 engage respective roller assemblies 84, 86, 88 and 90 which reduce frictional drag on the elongate elements.

Various embodiments of guide elements 74, 76, 78 and 80 are illustrated in FIGS. 7A–7D, and will be described hereinbelow.

Second ends of the groups 54, 56, 58 and 60 of elongate elements 50 are selectably engaged with retaining slits in respective user appendage engagement attachments 94, 96, 98 and 99. User appendage engagement attachments 94 and 96 are typically hand grips, while user appendage engagement attachments 98 and 99 are foot engagement straps which may include VELCRO R type closings.

According to an alternative embodiment of the invention elongate elements may be provided which do not terminate at the central connector 30 but rather slidingly traverse the central connector. Such elongate elements thus extend between two user appendage engagement attachments as indicated at reference numeral 100 in FIG. 1.

Figure 7A:
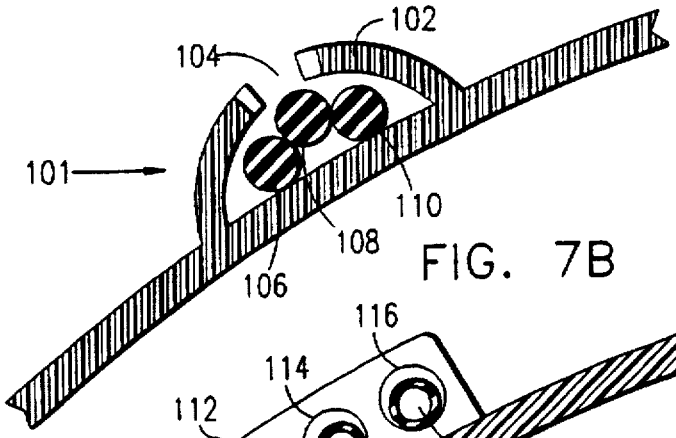
FIGS. 7A, 7B, 7C and 7D are illustrations of four different guide elements useful in the present invention.

Referring now to FIGS. 7A–7D, four alternative embodiments of guide elements are illustrated. FIG. 7A illustrates a guide element 101 defining a collar 102 having a relatively narrow slit 104 and which retains three elongate elements 106, 108 and 110 in slidable engagement therewith.

Figure 7B:
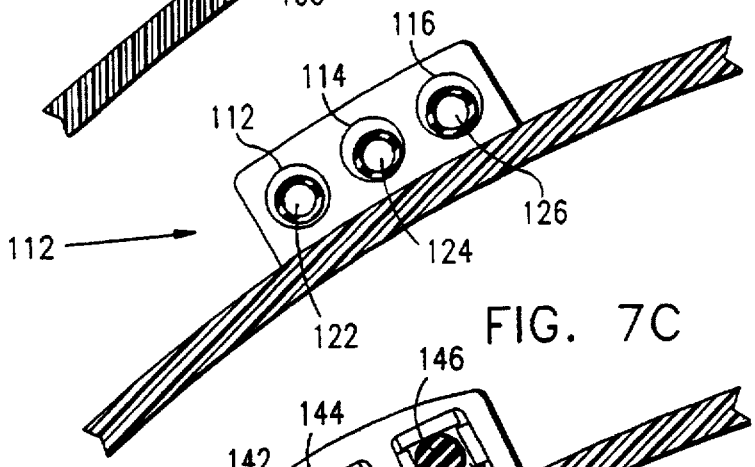

FIG. 7B illustrates a guide member 112 including separate apertures 112, 114 and 116 for individual elongate elements 122, 124 and 126.

Figure 7C:
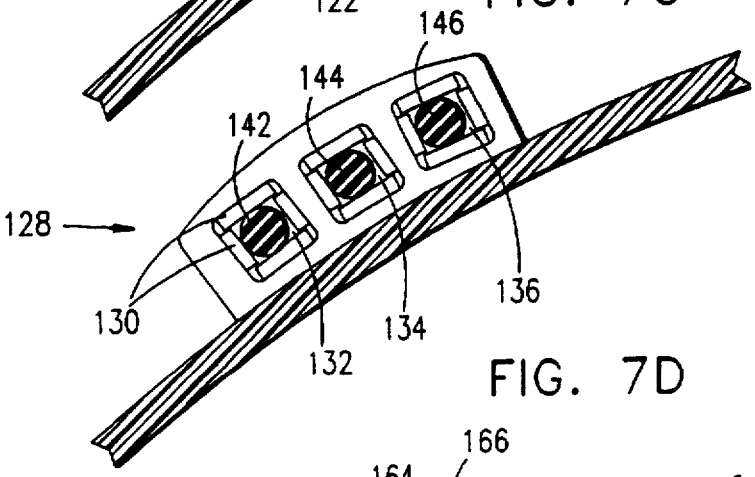

FIG. 7C illustrates a guide member 128 having needle bearings 130 on all four sides of each of three apertures 132, 134 and 136 through which respective individual elongate elements 142, 144 and 146 pass.

Figure 7D:
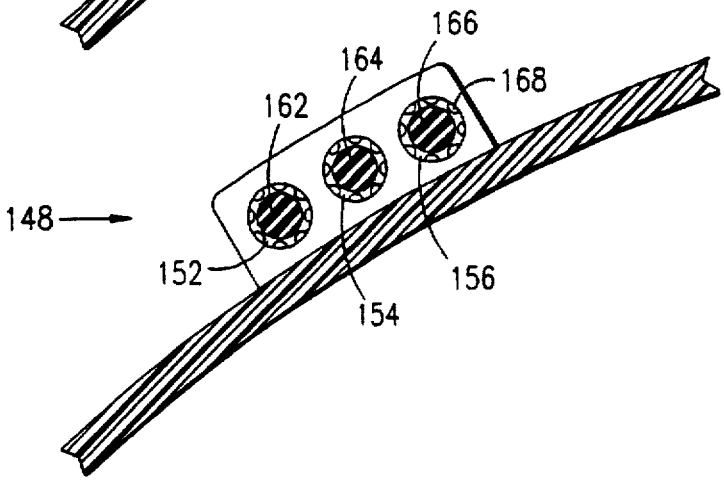

FIG. 7D illustrates a guide member 148 having ball bearings arranged about the periphery of each of three apertures 152, 154 and 156 through which respective individual elongate elements 162, 164 and 166 pass.

The operation of the fitness apparatus of FIGS. 1, 2A, 2B and 7A–7D will now be described with reference to FIGS.

3–6. The fitness apparatus of the present invention has the advantage that it can be worn by a user much as an ordinary vest and without restricting the user's type or range of movements. It can be used for adding resistance to ordinary motions, such as walking or running or for carrying out specific muscle group exercises.

Figure 3:
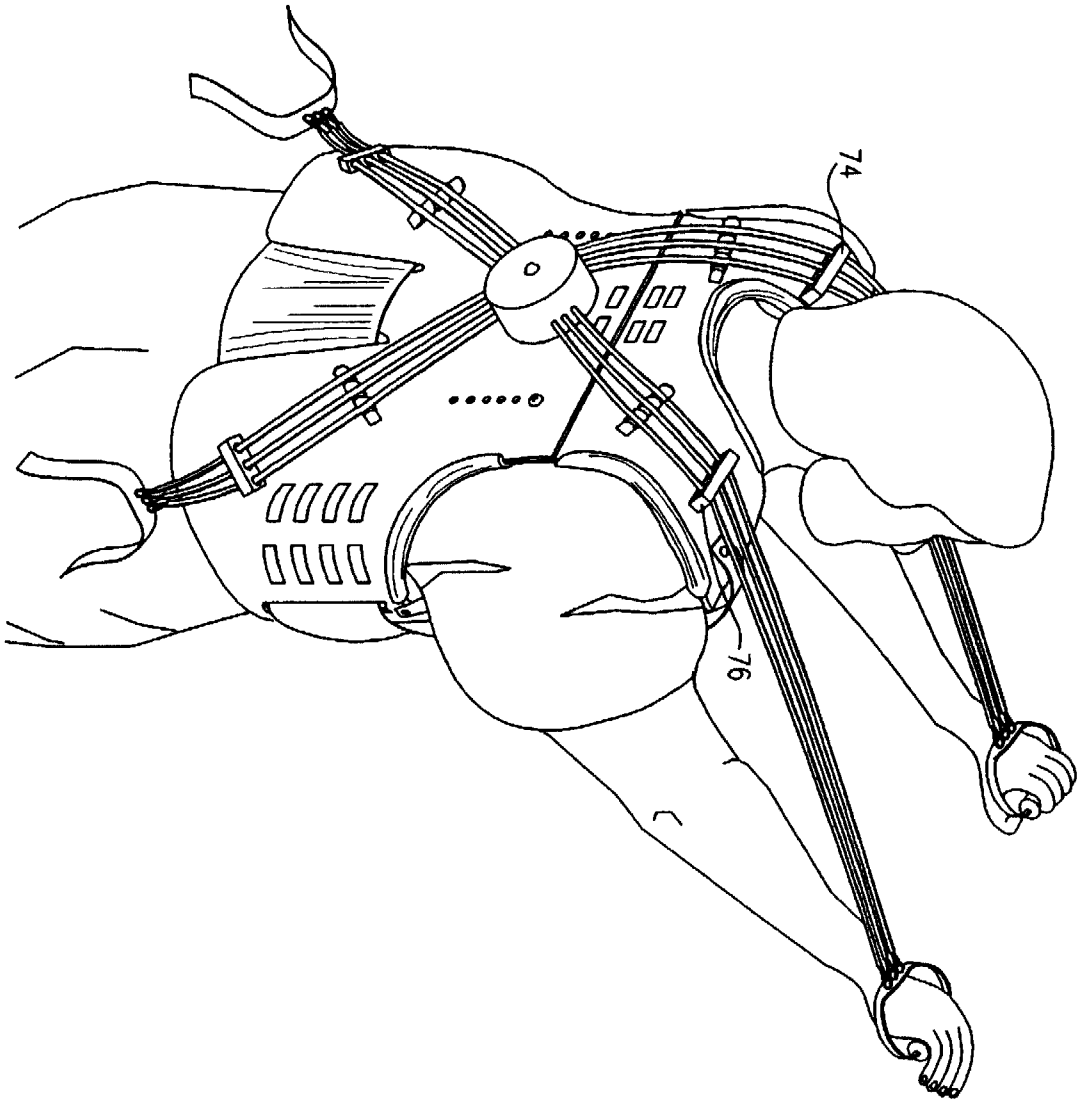
FIG. 3 is a pictorial illustration of the fitness apparatus of FIGS. 1 and 2 being used for forward arm stretch exercises.

FIG. 3 illustrates the fitness apparatus being used for forward arm stretch exercises. It is seen that the elongate members stretch up to 3–4 times their unstretched length. The location of guides 74 and 76 is seen in FIG. 3 and in FIG. 4 to be adjacent the pivots of the user's arms, so as to provide resistance generally parallel to the direction of displacement of the user's hands. The provision of the rollers and the guides ensures that frictional resistance does not interfere with stretching of the elongate elements.

Figure 4:
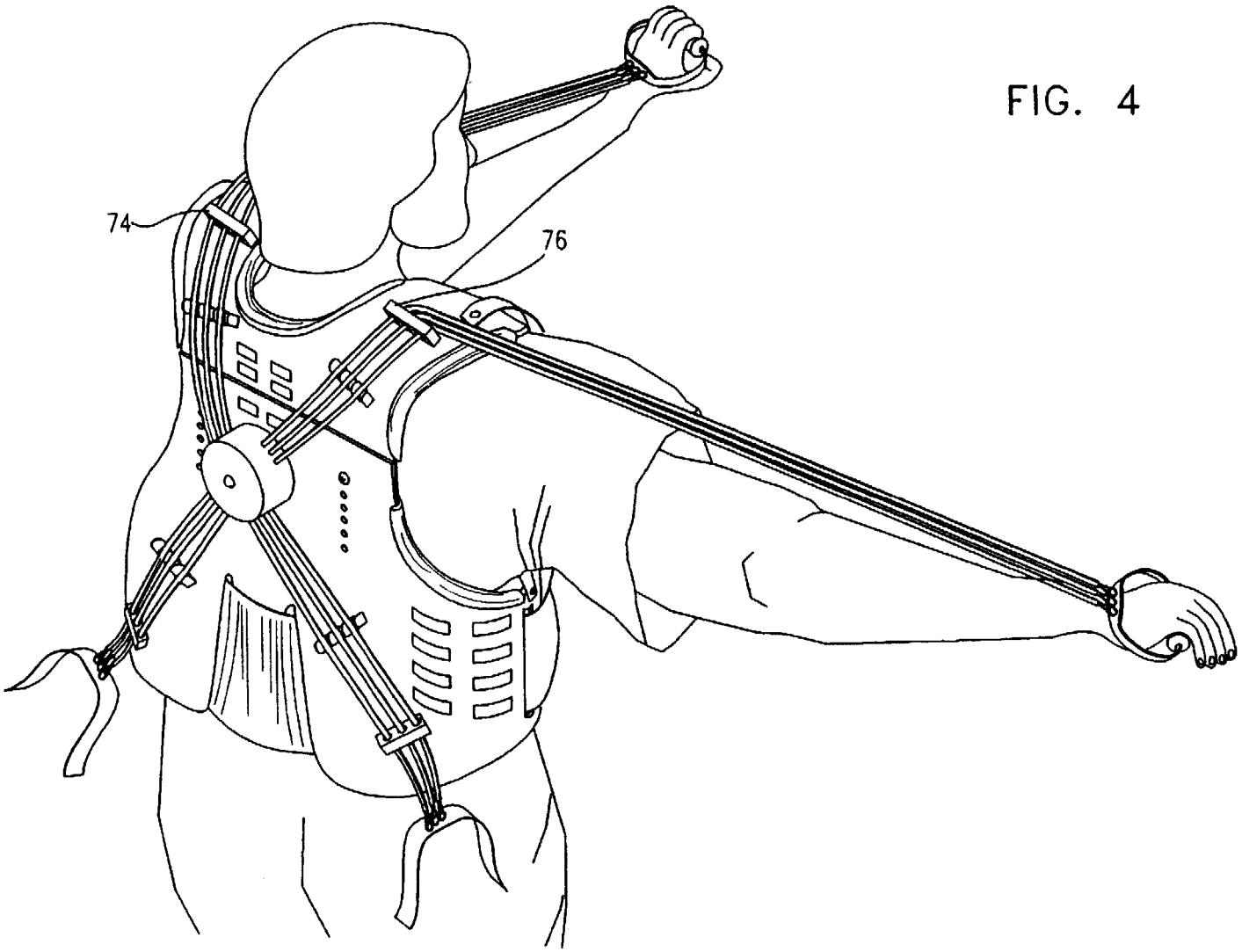
FIG. 4 is a pictorial illustration of the fitness apparatus of FIGS. 1 and 2 being used for side arm stretch exercises.

FIG. 4 illustrates the fitness apparatus of FIGS. 1 and 2 being used for side arm stretch exercises. It is seen that the elongate member is bent at nearly 90 degrees at guide 76. In order to reduce frictional resistance with the elongate element during stretching, the embodiments of guides shown in FIGS. 7C and 7D are preferred.

Figure 5:
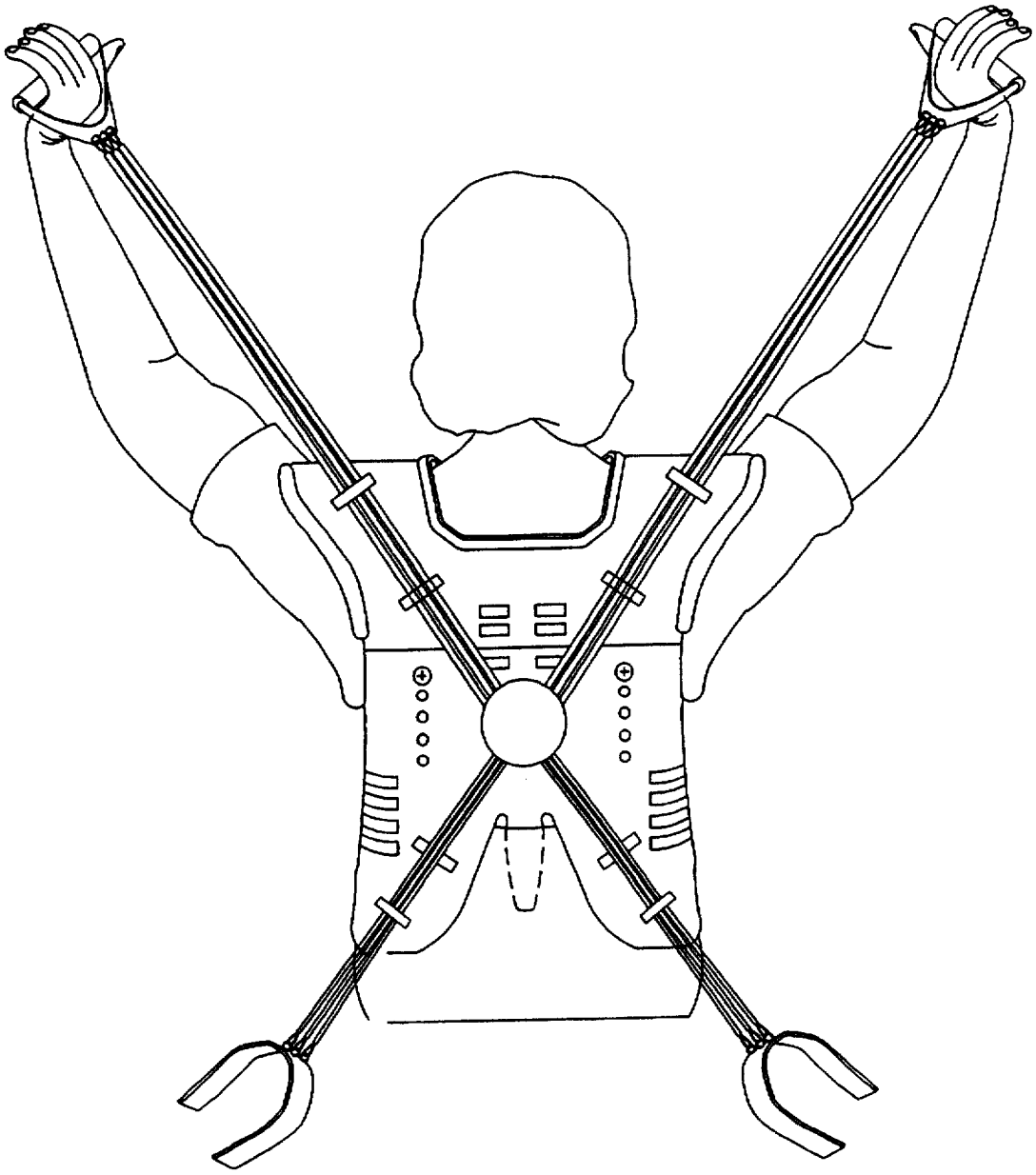
FIG. 5 is a pictorial illustration of the fitness apparatus of FIGS. 1 and 2 being used for raised arm stretch exercises.
Figure 6:
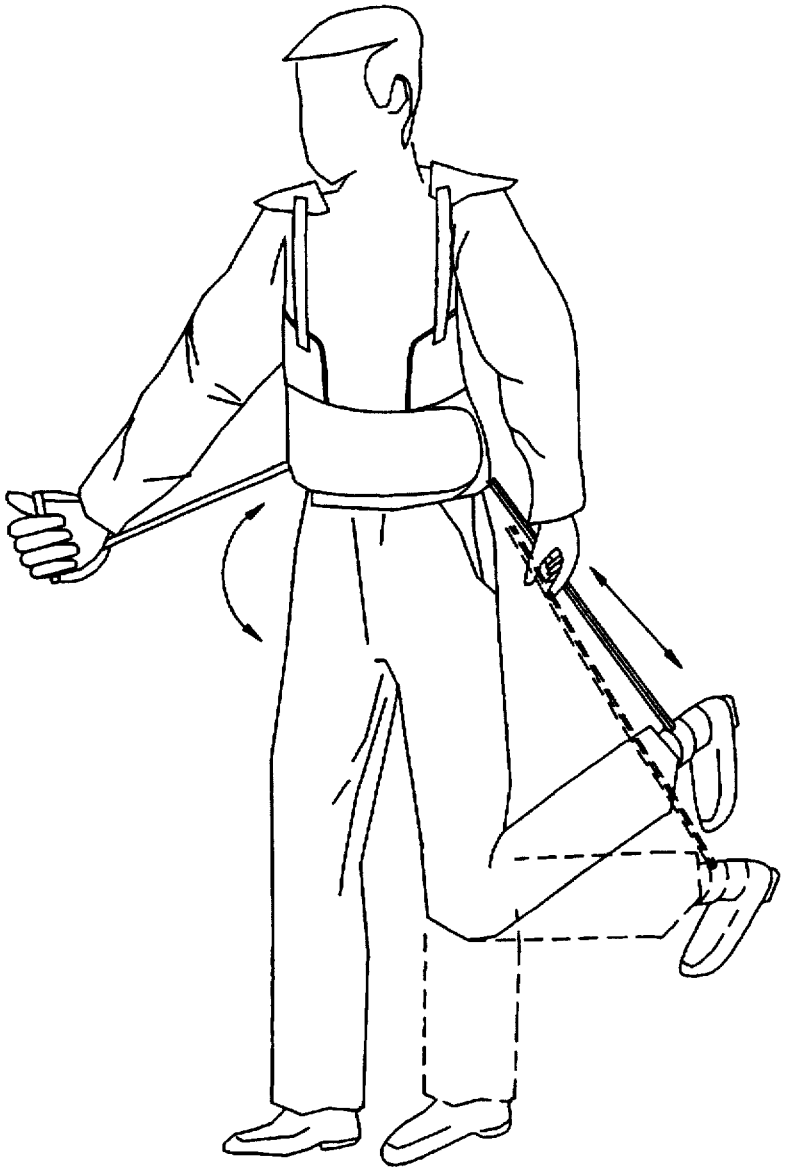
FIG. 6 is a pictorial illustration of the fitness apparatus of FIGS. 1 and 2 being used for arm and leg exercises.

FIG. 5 illustrates the fitness apparatus of FIGS. 1 and 2 being used for raised arm stretch exercises and FIG. 6 illustrates the fitness apparatus of FIGS. 1 and 2 being used for arm and leg exercises.

It is a particular feature of the present invention that the user can select the amount of resistance applied to any of the user appendage engagement attachments by selecting which and how many of the elongate elements are attached thereto. For example, where three elongate elements each having a different resistance are selectably connectable to the user appendage engagement attachments, five different resistance levels are realizable. Preferably, the individual elongate elements are color coded to indicate their resistance to stretching.

Figure 8A:
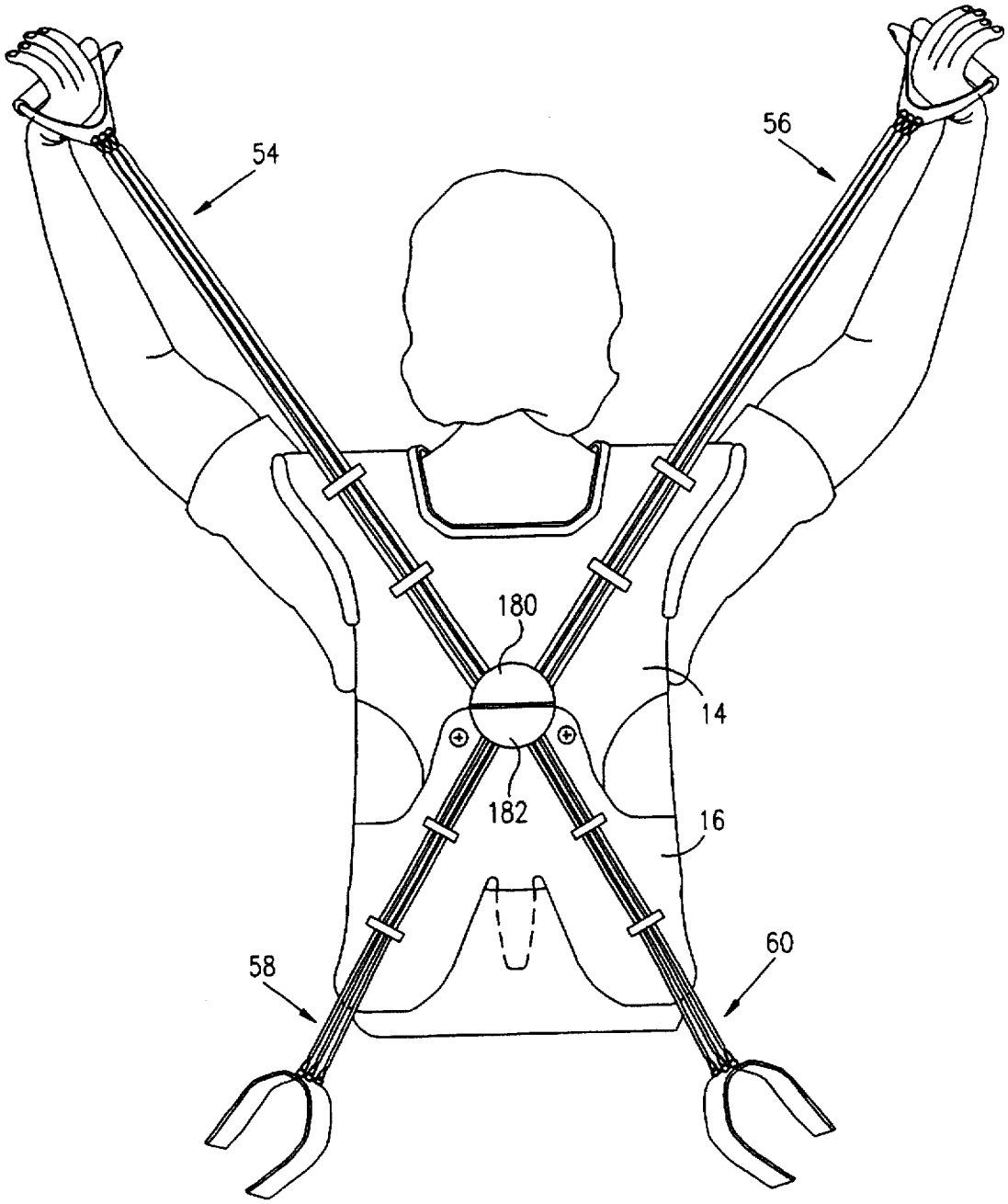
FIGS. 8A and 8B are illustrations of fitness apparatus constructed and operative in accordance with another preferred embodiment of the present invention in respective retracted and extended orientations for use by relatively short and relatively tall persons respectively.
Figure 8B:
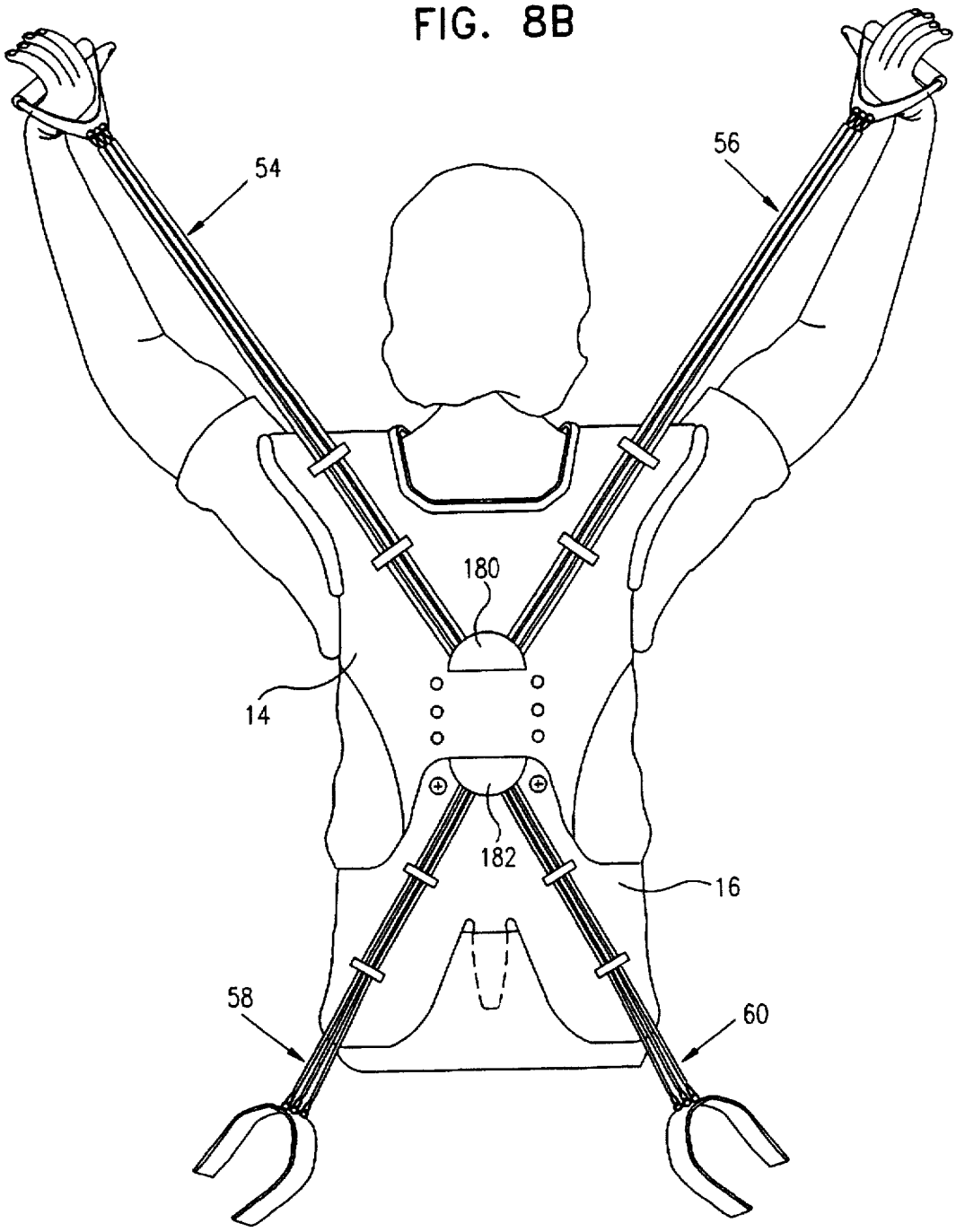

Reference is now made to FIGS. 8A and 8B which are illustrations of fitness apparatus constructed and operative in accordance with another preferred embodiment of the present invention in respective retracted and extended orientations for use by relatively short and relatively tall persons respectively.

The fitness apparatus of FIGS. 8A and 8B may be generally identical to that illustrated in FIGS. 1–9D, except in that the central connector 30 of FIG. 1 is bifurcated into top and bottom connectors 180 and 182. The top connector 180 is preferably mounted onto upper back portion 14, while the bottom connector 182 is preferably mounted onto lower back portion 16. Groups 54 and 56 of elongate elements are preferably attached to the top connector 180, while groups 58 and 60 of elongate elements are preferably attached to the bottom connector 182.

The arrangement is preferably such that when the upper and lower back portions 14 and 16 are not extended, as in FIG. 8A, so as to fit a relatively short user, the top and bottom connectors 180 and 182 lie in close proximate relationship. When the upper and lower back portions 14 and 16 are extended, as shown in FIG. 8B, in order to accommodate a taller person, the top and bottom connectors 180 and 182 are repositioned accordingly.

The desired result is that the resistance provided by the elongate elements attached thereto in response to stretching thereof by a user is preferably independent of the amount of extension of back portions 14 and 16 and thus independent of the height of the user.

It is to be appreciated that the exercises illustrated are but a few examples of the various exercises that can be performed using the fitness apparatus of the present invention. The present invention is not limited by what has been particularly shown and described hereinabove. Rather the scope of the present invention is defined only by the claims which follow:

What is claimed is:

1. Fitness apparatus comprising:

an upper body wearable protective shell formed of a generally planar web material, which is sufficiently flexible so as to be generally conformable to a user's body and generally impact resistant;

a plurality of resiliently stretchable elongate elements mounted at first ends thereof on the protective shell; and a plurality of user appendage engagement attachments mounted at second ends of respective ones of said elongate elements, said protective shell being formed of a plurality of shell elements which are attachable together in plural differently partially overlapping arrangements to allow the protective shell to be selectably elongated in order to accommodate differently sized users.

2. Fitness apparatus according to claim 1 and also comprising a back support belt which secures said protective shell to a user's body and limits upward and downward movement of said protective shell relative to the user's body.

3. Fitness apparatus according to claim 1 and also comprising adjustable padded shoulder straps associated with said protective shell.

4. Fitness apparatus according to claim 1 and also comprising padding formed on an inside, body facing surface of said web material.

5. Fitness apparatus according to claim 1 and wherein said protective shell, when mounted on a user's body, moves with the user's body and permits relatively free body motion.

6. Fitness apparatus according to claim 1 and wherein said elongate elements are mounted at first ends thereof on the protective shell by means of a central mounting connector located on said protective shell at a location adapted to lie between the top third and lower two thirds of the upper body of the user.

7. Fitness apparatus according to claim 1 and also comprising a plurality of relatively low friction guide elements, each associated with at least one of said elongate elements and being adapted to be located in the vicinity of a natural pivot location of a body appendage by stretching of said at least one elongate element.

8. Fitness apparatus according to claim 7 and also comprising rollers mounted on said protective shell intermediate said central mounting connector and said guide elements and underlying said elongate elements.

9. Fitness apparatus according to claim 1 and wherein sudden release of any one of said elongate elements when stretched causes a corresponding one of said user appendage engagement attachments to impact on said protective shell.

10. Fitness apparatus according to claim 1 and wherein each of said plurality of user appendage engagement attachments is selectably attached to a second end of a selectable number said plurality of resilient elongate elements, thereby to provide a desired amount of resistance to stretching.

11. Fitness apparatus according to claim 1 and wherein said plurality of resilient elongate elements includes resilient elongate elements having differing resistance to stretching.

12. Fitness apparatus according to claim 1 and wherein each of said resilient elongate elements can be stretched to at least 3–4 times its length.

13. Fitness apparatus according to claim 1 and wherein said elongate elements are mounted at first ends thereof on respective top and bottom portions of the protective shell by means of respective top and bottom mounting connectors located on said protective shell at a location adapted to lie between the top third and lower two thirds of the upper body of the user.

14. Fitness apparatus comprising:

a vest which covers a majority of an upper body of a user, said vest having a waistband which may be wrapped around said user, said waistband being sufficiently wide and stiff to provide support to a midriff and a back of said user;

a plurality of resilient elements, each of said elements having a grip attached at an end thereof;

a central connector fixedly mounted on a central portion of a back portion of said vest; and a plurality of element guides fixedly mounted on said back portion of said vest; two of said element guides being located at respective right shoulder and left shoulder portions of said vest and another two of said element guides being located at respective right hip and left hip portions of said vest;

wherein said elements pass through said element guides and extend at least to said central connector, said grips being arranged for grasping by a right hand and a left hand of said user, and for engaging a right foot and a left foot of said user, wherein said vest is sufficiently rigid to protect said user from striking thereagainst by one of said elements and said grips upon sudden release thereof when stretched.

15. Fitness apparatus according to claim 14 wherein said plurality of elements comprises elements of different tensile resistance to pulling.

16. Fitness apparatus according to claim 14 wherein said resilient elements are color coded to indicate their tensile resistance to pulling.

17. Fitness apparatus according to claim 14 wherein at least one of said elements has grips at both opposite ends thereof and passes through said element central connector and two of said element guides.

18. Fitness apparatus according to claim 14 wherein said vest has ventilation openings formed therein.

19. Fitness apparatus according to claim 14 and wherein said vest is formed of first and second elements which are attachable together in plural differently partially overlapping arrangements to allow the vest to be selectably elongated in order to accommodate differently sized users.

20. Fitness apparatus according to claim 19 and wherein said central connector comprises first and second central connector elements respectively fixedly mounted on said first and second elements.

* * * * *